US007661249B2

(12) United States Patent
Monti

(10) Patent No.: US 7,661,249 B2
(45) Date of Patent: Feb. 16, 2010

(54) DEVICE FOR PICKING UP ARTICLES FROM A SUPPLY STATION AND DEPOSITING THE ARTICLES IN CORRESPONDING BLISTERS OF A BLISTER STRIP

(75) Inventor: Giuseppe Monti, Pianoro (IT)

(73) Assignee: Marchesini Group, S.p.A., Pianoro (Bologna) (IT)

( * ) Notice: Subject to any disclaimer, the term of this patent is extended or adjusted under 35 U.S.C. 154(b) by 165 days.

(21) Appl. No.: 12/041,280

(22) Filed: Mar. 3, 2008

(65) Prior Publication Data

US 2008/0223001 A1 Sep. 18, 2008

(30) Foreign Application Priority Data

Mar. 14, 2007 (IT) ..... BO2007A0178

(51) Int. Cl.
*B65B 35/38* (2006.01)
*B65B 5/12* (2006.01)

(52) U.S. Cl. ..... 53/539; 53/238; 53/240; 53/246; 53/247; 53/250

(58) Field of Classification Search ..... 53/158, 53/539, 237, 238, 240, 244, 246, 247, 250; *B65B 35/38, B65B 5/12*
See application file for complete search history.

(56) References Cited

U.S. PATENT DOCUMENTS 2,457,220 A * 12/1948 Fowler et al. ..... 53/244
2,546,838 A * 3/1951 Tasche ..... 53/247
2,957,290 A * 10/1960 Andreessen ..... 53/240
3,091,067 A * 5/1963 Ulicky et al. ..... 53/244
3,592,336 A 7/1971 Thurston et al.
3,604,184 A * 9/1971 Shuttleworth ..... 53/157
3,729,888 A * 5/1973 Carle ..... 53/247
3,986,638 A * 10/1976 DeHart ..... 221/150 A
4,525,985 A * 7/1985 Sammens ..... 53/247
4,693,057 A * 9/1987 Rittinger et al. ..... 53/539

(Continued)

FOREIGN PATENT DOCUMENTS

DE 33 33 301 A1 3/1985

(Continued)

*Primary Examiner*—Stephen F Gerrity
(74) *Attorney, Agent, or Firm*—William J. Sapone; Coleman Sudol Sapone P.C.

(57) ABSTRACT

A device for picking up articles from a supply station and depositing the articles in corresponding blisters of a blister strip, comprising: at least a group of depression-activated gripping units, each of which units is shaped to a specific format for receiving and retaining a corresponding article having predetermined lie and orientation; connecting organs of the gripping units to an operating head whereby the gripping units are positioned in relation to a positioning of the corresponding blisters afforded in the blister strip; organs for moving the operating head in outward and return runs, respectively between the supply station of the articles and a release station of the articles in the corresponding blisters of the blister strip; enabling organs being activated in phase-relation with the movement organs, for activating the gripping units in the supply station, which gripping units collect a number of articles equal to a number of the gripping units, and for deactivating the gripping units in the release station with a disengagement of the articles from the gripping units and a falling of the articles into the corresponding blisters of the blister strip.

21 Claims, 7 Drawing Sheets

U.S. PATENT DOCUMENTS

| | | | | | |
|---|---|---|---|---|---|
| 4,832,180 | A | * | 5/1989 | Ferrero | 198/468.3 |
| 5,442,892 | A | * | 8/1995 | Burns, III et al. | 53/559 |
| 5,706,634 | A | * | 1/1998 | Edwards et al. | 53/247 |
| 6,311,462 | B2 | * | 11/2001 | Amborn et al. | 53/539 |
| 6,558,584 | B1 | * | 5/2003 | O'Neill et al. | 53/247 |
| 7,073,312 | B2 | * | 7/2006 | Battisti | 53/537 |
| 2002/0104291 | A1 | | 8/2002 | Kondou | |
| 2008/0222999 | A1 | * | 9/2008 | Monti | 53/244 |
| 2008/0282646 | A1 | * | 11/2008 | Gertitschke et al. | 53/244 |
| 2009/0056283 | A1 | * | 3/2009 | Monti | 53/475 |

FOREIGN PATENT DOCUMENTS

| | | | | | |
|---|---|---|---|---|---|
| DE | 42 08 818 | A1 | | 9/1993 | |
| DE | 199 26 893 | A1 | | 12/2000 | |
| DE | 102004006375 | A1 | * | 9/2005 | |
| EP | 0 224 017 | A | | 6/1987 | |
| EP | 0 239 547 | A | | 9/1987 | |
| EP | 876957 | A1 | * | 11/1998 | |
| GB | 2172257 | A | * | 9/1986 | |
| JP | 53074991 | A | * | 7/1978 | |
| JP | 03279112 | A | * | 12/1991 | |
| JP | 2003081223 | A | * | 3/2003 | |
| JP | 2006036336 | A | * | 2/2006 | |
| WO | WO 96/17776 | A | | 6/1996 | |

* cited by examiner

FIG.14
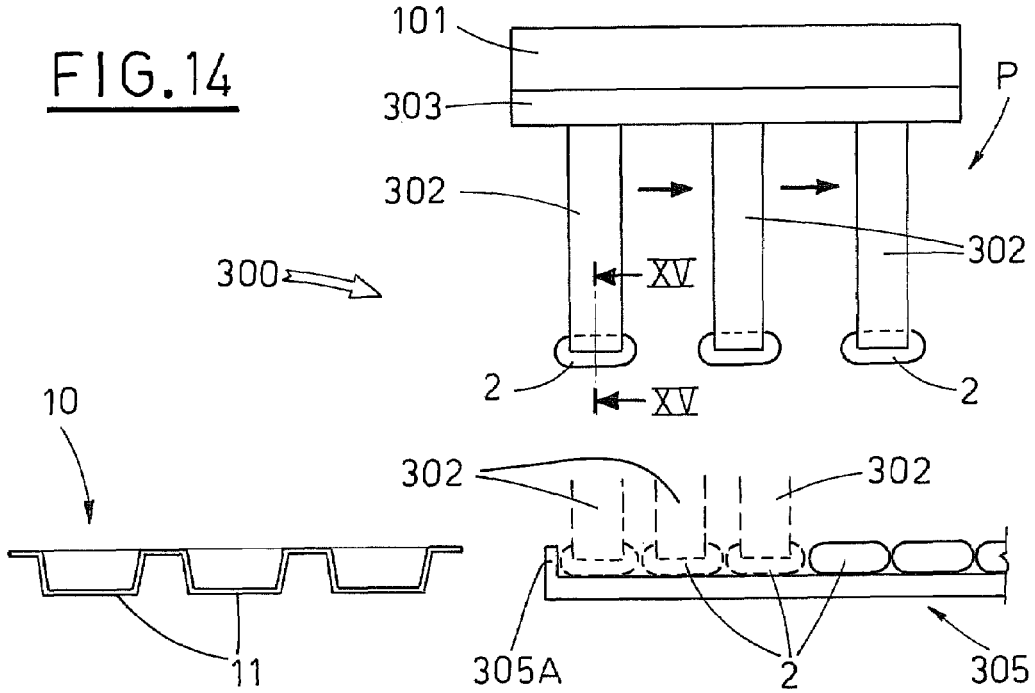
FIG.15
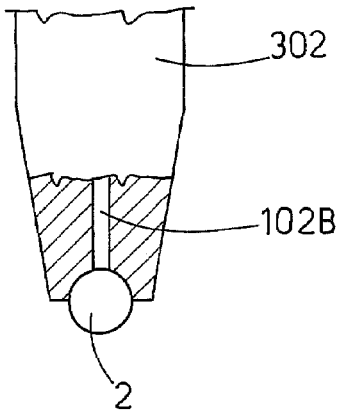
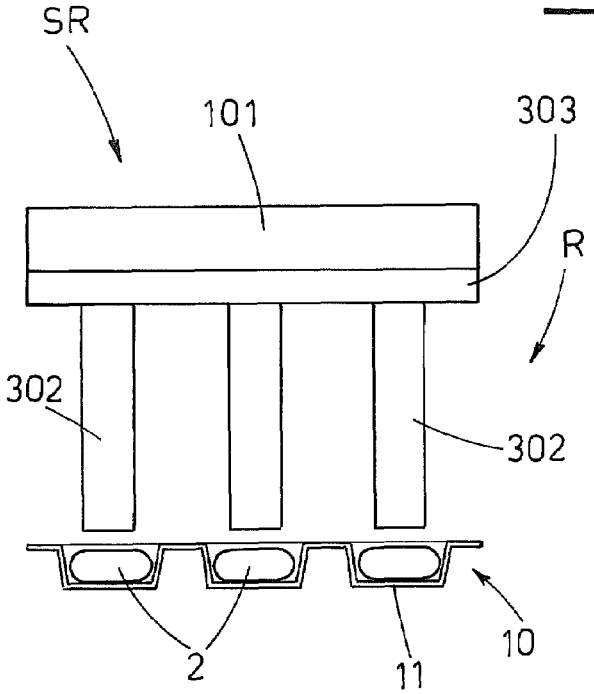
FIG.16

10
2B
1
2A
2B
2A

2A
SR
2B
402
400
401B
2B
402

10
11B
11A
11B
L
11B
11A
11B
SR
2A
402
402
2A
401A

DEVICE FOR PICKING UP ARTICLES FROM A SUPPLY STATION AND DEPOSITING THE ARTICLES IN CORRESPONDING BLISTERS OF A BLISTER STRIP

BACKGROUND OF THE INVENTION

The invention relates to the technical sector of automatic machines, step-operating or continuous, for packaging products such as pills, tablets and the like in blisters of a heat-formed strip, in order to obtain packs known as blister-packs.

In the above machines, known as blister packers, in a constructional design which is common to many realizations, a first operating line is included in which the smooth strip is unwound from a reel and taken to a forming station in which the blisters are made by heat-impression; the heat-formed strip then proceeds towards a filling station in which products are selected, ordered and supplied to inserting organs, which fill each blister, with usually a single product being placed in a single blister.

Downstream of the filling station are situated further stations in which the heat-formed strip, with the blisters filled, is sealed, controlled, cut to separate one blister pack from another; the properly-formed blisters packs are then supplied to an outlet station, while the defective ones are deviated to a reject station.

In the blister packer, the filling station is of particular importance, and so is the technical solution used for realizing the inserting organs.

The prior art comprises various forms of realization for the insertion organs.

A known solution comprises arranging, immediately above the blister strip, a sort of open-bottomed tray in which the products are supplied loose and plentifully and are caused to enter into the transiting underlying blisters, by force of gravity and with the aid of means for ensuring entrance of a single product per blister, its correct arrangement internally of the blister and a preferred distribution of the articles in the tray, in greater quantities upstream and smaller quantities downstream.

This solution has the advantage of not including specially-shaped organs either in relation to the product or to the arrangement or orientation of the blisters in the blister pack, so that upon changing the shape and arrangement of the blisters no component substitution is required.

The insertion of the products in the blisters has shown itself to be better when the products are disc-shaped than when they are elongate; in the latter case the difficulties in insertion increase if the blisters are transversally arranged with respect to the advancement direction of the heat-formed ribbon; further, the required increased re-sorting of the products in the tray has shown itself to be disadvantageous with regard to the integrity of some types of pills, i.e. those more fragile than the others.

A further known solution describes how to order the products in a direction towards a series of chutes, arranged aligned with the corresponding rows of cells transiting below and opening just above the upper surface of the heat-formed strip.

A row of products forms in each channel of the chute, which row is retained at the bottom by the heat-formed strip, in the zones between one blister and another, while the release of a product, by force of gravity, is allowed upon the passage of each of the concavities defining the blisters.

In variants of the above solution, intercepting organs are included at the base of the rows of products in the chutes, which organs are opened in phase relation with the passage of the blisters.

This solution requires a complex system of vibrating planes for supplying the chutes, made in a suitable shape, which therefore have to be replaced at each change of product format.

The conformation of the chutes, specific for each product format, does not prevent occasional clogging with a consequent halting of the descent of the pills; which clogging is more or less frequent according to the shape of the products themselves; further, the solution exhibits greater functionality, with elongate products, if the blisters are arranged parallel to the advancement direction of the heat-formed strip.

Another solution teaches the use of a master strip in which blisters are realized having the same shape and arrangement as the heat-formed strip.

The master strip develops in a closed-ring trajectory in which an upper branch and a lower branch are defined, with the lower branch facing and above the heat-formed strip, in phase relation there-with, such that the blisters are mutually aligned in the zone of common trajectory.

The products are inserted in the blisters of the master strip on the upper branch; the blisters are holed at the base and are placed in communication with a source of depression which places them in depression, such as to retain the products inserted both in the curved connecting tract and in a part of the lower branch, up to a predetermined point in which the aspiration is stopped, allowing the product to fall into the corresponding underlying blisters of the heat-formed ribbon.

In a further solution (see WO2005/075293) the master strip is provided with shaped blisters which are located at the side of the blistered ribbon, perpendicularly thereto.

The products are inserted in the blisters of the master strip at the zone thereof which is further from the heat-formed ribbon, and when the products reach the closest zone they are aspiratingly removed by means of a head having multiple gripping organs, borne by a robotic arm able to transfer the head onto the heat-formed ribbon in order to enable depositing of the products in the blisters thereof.

If the heat-formed ribbon is continuously activated, the robotic arm is able to move the head in order to follow the strip over a tract which is sufficient to enable discharge of the products.

The solutions with the master strip have the advantage of preparing the products optimally for insertion in the respective blisters, removing from the line the problems which might relate to special product shapes and/or arrangement of the blisters on the heat-formed ribbon, which can lead to insertion difficulties, thus limiting the risk of having defective blisters; a disadvantage, however, is that there is greater organ complexity, making them more expensive and the system excessively rigid, all of this resulting in long and laborious interventions for setting up the machine for a product format change and/or the blister pack change.

The described prior art solutions exhibit both advantageous and disadvantageous aspects which make one or the other preferable time by time, according to special needs. Each however lacks the sufficient operative flexibility required for best exploiting the machine when changing the production requirements, in particular when changing the format of the articles and the mutual disposition of the blisters in the blister strips.

The above-described solutions can be used both with step-activated machines and with continuous machines; the speed of the latter represents a further variable which can modify, in obviously different ways, the operative functionality of the solutions.

SUMMARY OF THE INVENTION

An aim of the present invention is therefore to provide a device for picking up articles from a supply station and depositing the articles in corresponding blisters of a blistered strip, conformed such that the functioning thereof is not influenced by the format of the products and/or the arrangement of the blisters in the relative blister strip.

A further aim of the invention relates to providing a device offering optimal functioning even with high operating speed of the blister packer to which it is associated, contributing significantly to guaranteeing the reliability of the packer.

A further aim of the invention consists in providing a device constituted by a limited number of organs, with a minimum of these being size-specialized, so that good flexibility can be obtained with realization costs as limited as possible.

The above aims are obtained by means of a device for picking up articles from a supply station and depositing the articles in corresponding blisters of a blister strip, wherein it comprises: at least a group of depression-activated gripping units, each of which units is shaped to a specific format for receiving and retaining a corresponding article having predetermined lie and orientation; connecting organs of the gripping units to an operating head in which the gripping units are positioned in relation to a positioning of the corresponding blisters afforded in the blister strip; organs for moving the operating head in outward and return runs, respectively between the supply station of the articles and a release station of the articles in the corresponding blisters of the blister strip; enabling organs being activated in phase-relation with the movement organs, for activating the gripping units in the supply station, which gripping units collect a number of articles equal to a number of the gripping units, and for deactivating the gripping units in the release station with a disengagement of the articles from the gripping units and a falling of the articles into the corresponding blisters of the blister strip.

BRIEF DESCRIPTION OF THE DRAWINGS

The characteristics of the invention will emerge from the following description of some preferred embodiments of the device, according to what is set out in the claims and with the aid of the accompanying figures of the drawings, in which:

FIG. 14 illustrates a section view along plane XIV-XIV of FIG. 13;

FIG. 15 is an enlarged-scale view of a section along plane XV-XV of FIG. 14;

FIG. 16 is, in the same view as in FIG. 14, the head of the device in a stage of filling the blisters of a blister strip;

DESCRIPTION OF THE PREFERRED EMBODIMENTS

Figure 1:
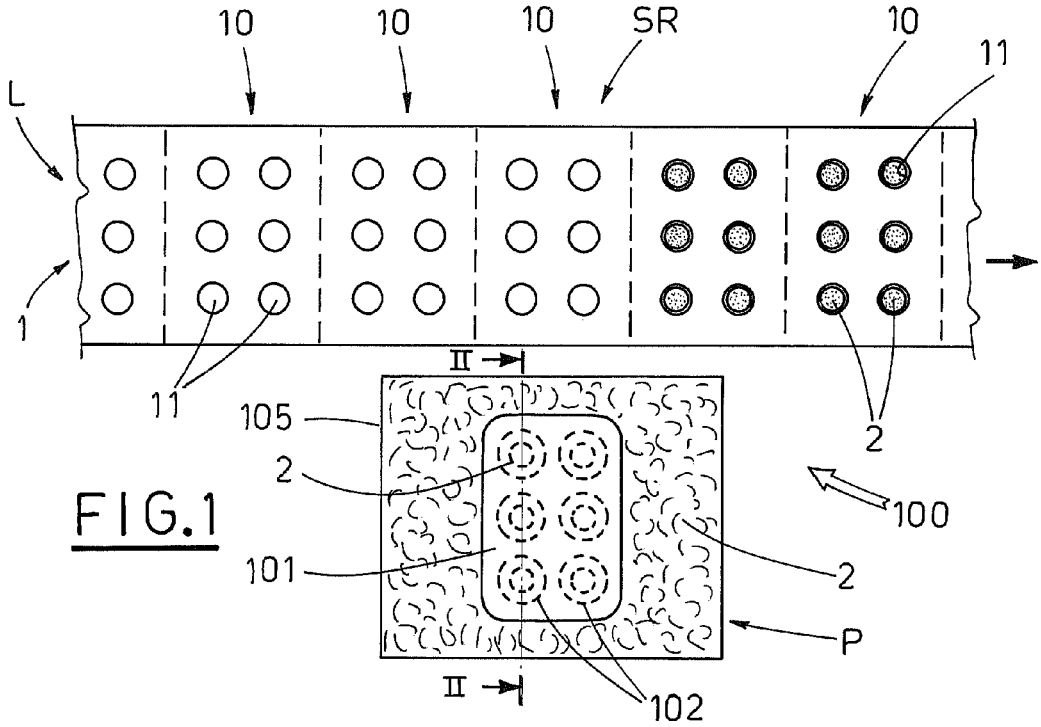
FIG. 1 is a schematic plan view of an operating head of the device, in a first embodiment thereof, during a stage of picking up the articles, and a portion of heat-formed strip having blisters to be filled.

With reference to figures from 1 to 8, 100 denotes in its entirety the device of the invention, in a first embodiment thereof.

With reference to figures from 9 to 11, the device, in a second embodiment, is denoted by number 200.

With reference to figures from 12 to 16, the device, in a third embodiment, is denoted by number 300.

With reference to figures from 17 to 19, the device, in a fourth embodiment, is denoted by number 400.

The device, in any of the above-indicated embodiments described herein, is destined, preferably, to be associated to a blister-packer machine of known type, as mentioned in the introduction hereto, not illustrated in detail in the following, in which a transport line L is included to advance a blistered heat-formed strip 1 up to a filling station SR, in which the device operates the insertion of articles 2, for example pills, pastilles or the like, in corresponding blisters 11, realized in the heat-formed strip 1 in a predetermined order, to define a succession of portions 10 of a blistered strip, in the following indicated as a blister strip, or simply a blister, identified in the figures, for reasons of clarity, by broken separating lines.

Further stations (not illustrated) are arranged downstream of the filling station SR, in which the heat-formed strip 1, with the filled blisters 11, is controlled, sealed and cut in order to separate one blister strip portion 10 from another.

For the sake of descriptive and illustrative simplicity, in the following description a step-activated blister packer machine is illustrated; therefore, each blister strip 10 pauses in the filling station SR for the time required for the device to perform the operating stages.

Figure 2:
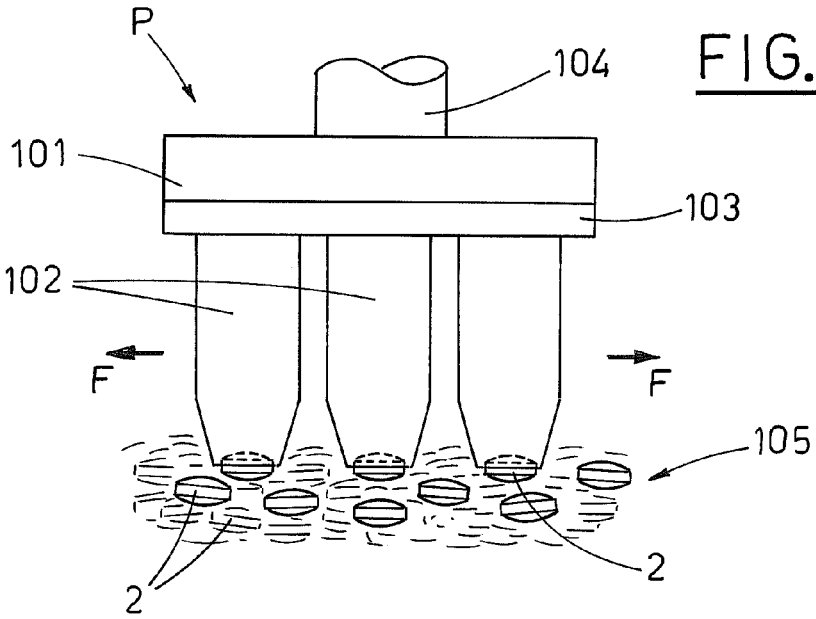
FIG. 2 is an enlarged-scale illustration of a section of the head according to the plane II-II of FIG. 1.
Figure 3:
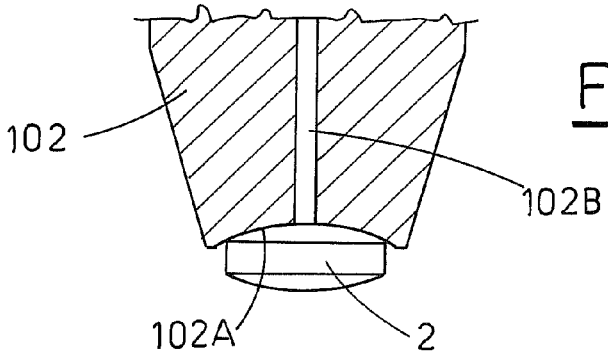
FIG. 3 is a partial illustration, in further enlarged scale, of a gripping unit of the device, in vertical section.

The device 100, in the first embodiment, comprises an operating head 101 provided with a plurality of depression-activated gripping unit 102, facing downwards with a vertical axis and each constituted by an elongate body at which lower end a seating 102A is shaped, communicating with an aspirating conduit 102B realized axially in the body of the relative gripping unit 102 (FIGS. 2, 3).

The aspirating conduits 102B are connected to intercepting (or enabling) organs, not illustrated, the opening/closing of which allows or prevents connection of the unit 102 with a depression source, external of the operating head 101, also not illustrated.

Each seating 102A is shaped such as to receive and retain a corresponding article 2 having a predetermined lie and orientation.

The gripping units 102 constrained to the operating head 101 by connecting organs 103 are mutually arranged to define, in a horizontal plane, contours which are the same as the contours of the blisters of a corresponding blister strip.

In the first embodiment of the device 100 there is a number of gripping units 102 which is equal to the number of blisters 11 in each blister strip, with the connecting organs 103 of fixed type being constituted, for example, by a plate, to which the gripping units 102 are solidly constrained.

The example of figures from 1 to 5 relates to disc-shaped articles 2, with convex flanks, to be inserted, flat, into six blisters 11 having a circular plan, afforded in each blister strip 10, by means of a group of six gripping units 102.

For these articles the seatings 102A are shaped complementarily to one of the convex flanks (see in particular FIG. 3) while a predetermined angular position of the bodies of the gripping units 102 is not necessary in order to define a particular orientation of the article 2 on the horizontal plane.

The example of figures from 6 to 8 relates to an elongate article 2, having a round transversal section, to be inserted, flat, in elongate-plan blisters afforded in each blister strip 10.

For these articles 2 the seatings 102A are shaped such as to couple with the upper part of the article 2, when the article is flat, defining the orientation on the horizontal plane (see in particular FIG. 8), while the body of each gripping unit 102 is arranged with an angular position such that the relative seating 102A has the same orientation as the corresponding blister 11 in the blister strip 10.

Figure 6:
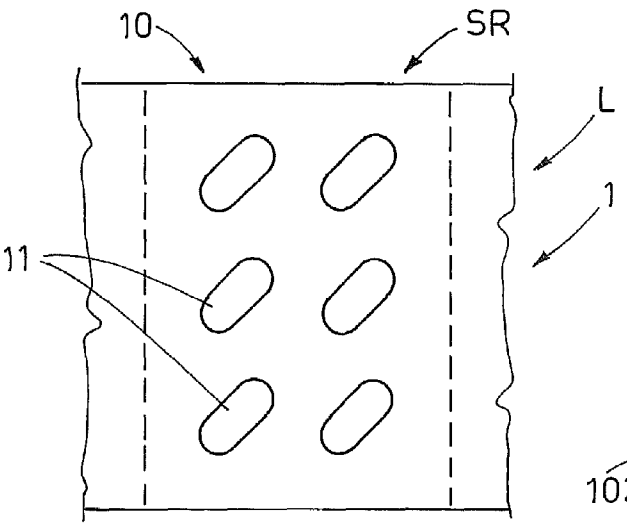
FIG. 6 is an enlarged-scale illustration, similar to FIG. 1, with the head of the device being adapted in shape to a type of article and to particular arrangement of the blisters.
Figure 6:
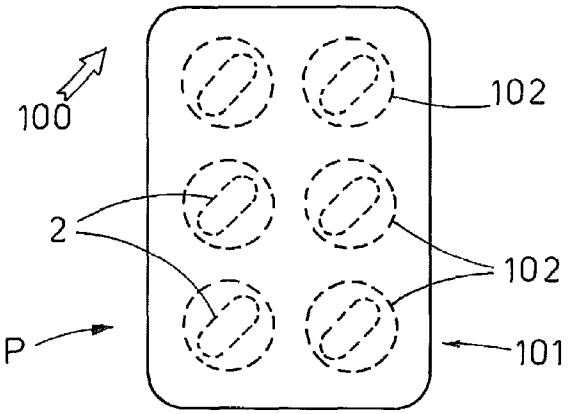

FIG. 6 illustrates a case in which six blisters 11 are afforded, arranged with a same diagonal orientation with respect to the blister strip 10; by the side of the heat-formed strip 1 the operating head 101 can be seen in plan view, with the six gripping units 102 being oriented such that the relative seatings 102A have the same diagonal inclination as the blisters 11 (broken lines).

Figure 7:
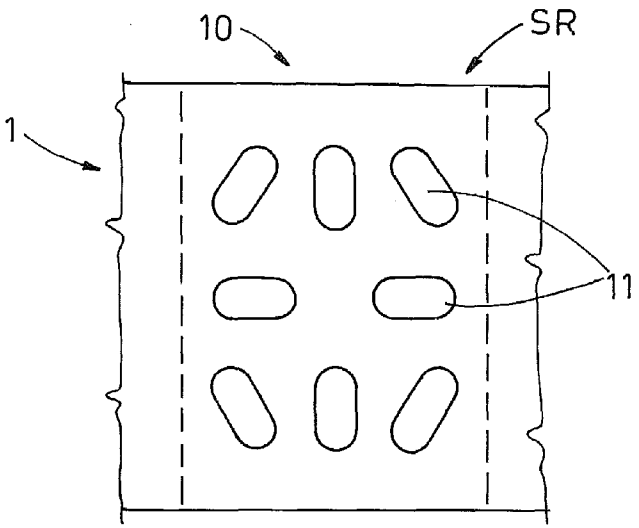
FIG. 7 is a similar view to that of FIG. 6, with the head of the device being adapted to the same type of article as in FIG. 6, but with a different arrangement of the blisters.
Figure 7:
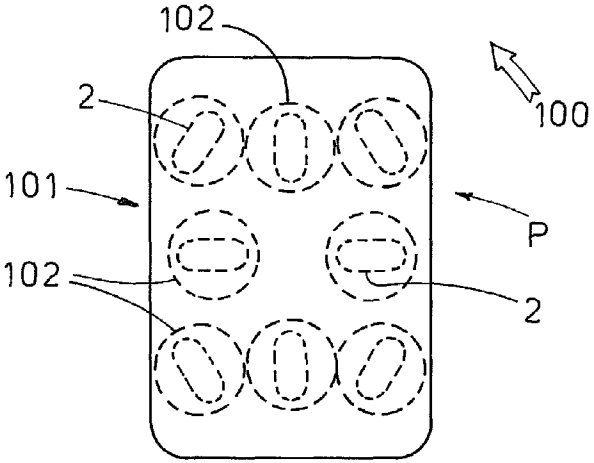

FIG. 7 illustrates a further case, in which eight blisters 11 are afforded, of which four are central and arranged in a cross-shape, and four are in corners having a diagonal orientation; similarly, by the side of the heat-formed strip 1, the operating head 101 can be seen in plan view with the eight gripping units 102 being positioned and oriented in the same way as the blisters (broken lines).

Movement organs 104 bear the operating head 101 and move it in outward and return runs, respectively from a supply or picking up station P of the articles 2 (FIGS. 1, 2, 6, 7) to a release station R thereof, at the position of the blister strip 10 (FIGS. 4, 5) and vice versa.

The movement organs 104, of which only the terminal portion is schematically represented in FIG. 2, are of substantially known type and are constituted for example by a robotic arm operating along Cartesian axes or being anthropomorphic, the movements of which robotic arm being suitably electronically-controlled, in agreement with the type of advancing motion of the heat-formed strip 1.

In the first embodiment, the picking up station P is defined by a tray 105 (FIGS. 1, 2, 4) in which the articles 2 are arranged loosely and in which organs (not illustrated) are provided for maintaining a predetermined level of the articles 2, as homogeneous as possible in the various zones of the same tray 105.

The functioning of the device 100 includes a first stage in which the operating head 101 is positioned, by the movement organs 104, at the picking up station P and lowered into the tray 105 such that the gripping units 102 are plunged into the heap of the articles 2 (FIGS. 1 and 2), with the intercepting organs of the aspirating conduits 1028 being open.

The movement organs 104, at this point, impress one or more horizontal movements on the operating head 101, the movements being of a predetermined amplitude and direction (arrows F in FIG. 2), to facilitate spontaneous engagement, by aspiration, of a corresponding article 2 in each seating 102A (FIGS. 2 and 3).

Figure 4:
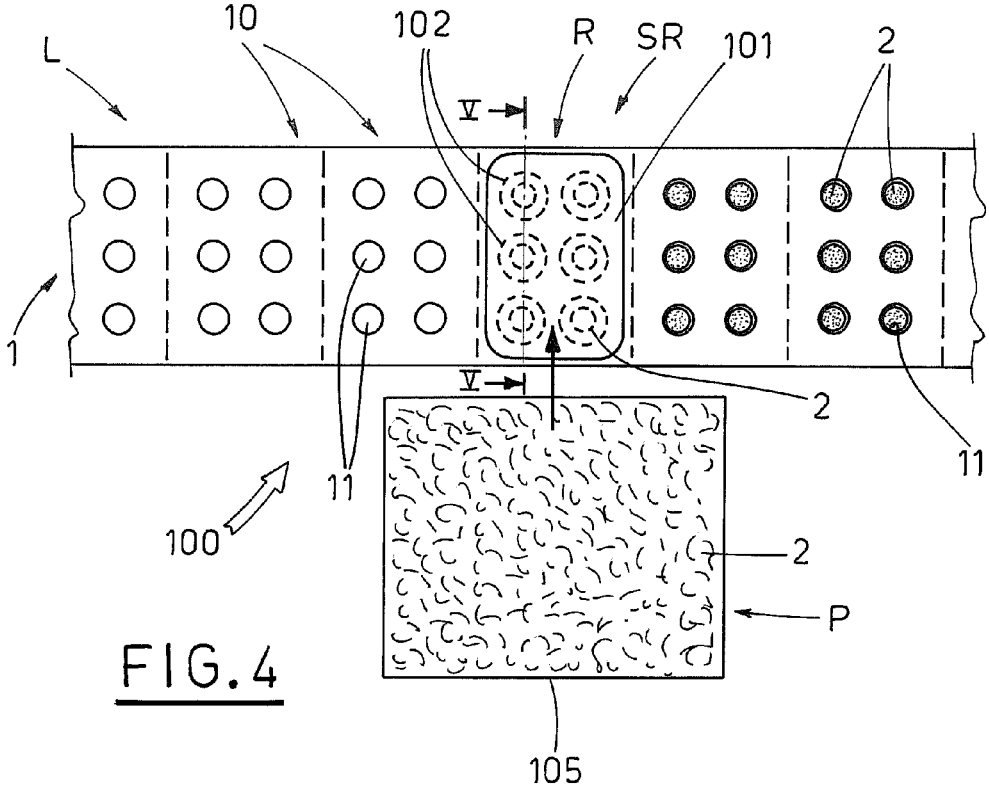
FIG. 4 is a similar view to that of FIG. 1, with the operating head in a stage of filling the blisters of a blister strip.

After a predetermined time, the head 101 is raised and transferred into the release station R, together with the articles 2 retained by aspiration by the relative gripping units 102 (FIG. 4).

Figure 5:
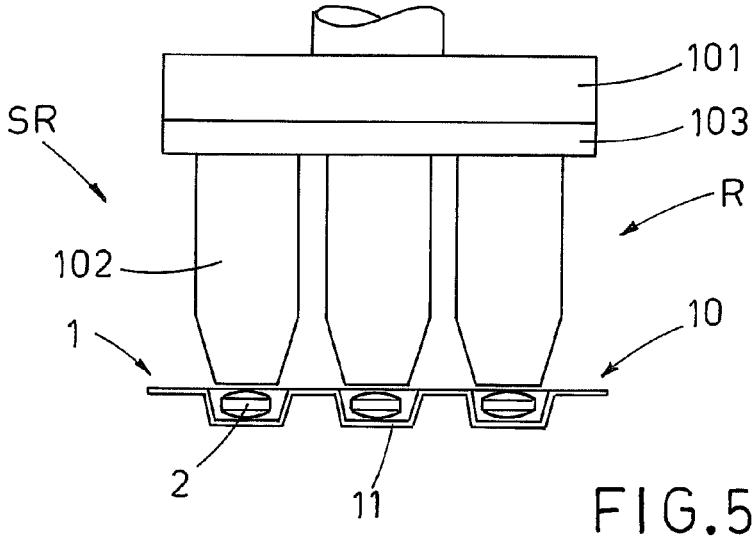
FIG. 5 is an enlarged-scale illustration of a section according to plane V-V of FIG. 4.

The closure of the intercepting organs, with a consequent resetting of the atmospheric pressure in the conduits 102B, leads to disengagement of the articles 2 from the seatings 102A and the falling thereof into the corresponding blisters (FIG. 5).

In a case in which the device 100 is associated to blister packer machines having continuous advancement of the heat-formed strip 1, the movement organs 104 have to allow the head 101 a follow-up run to follow the blister strip 10 such as to enable unloading of the articles 2 into the blisters 11.

The device 100 can comprise control means, not illustrated, for verifying that all the seatings 102A have in fact picked up a corresponding article 2, thus guaranteeing the filling of all the blisters 11; these control means can be, for example, associated to each gripping unit 102 and can determine the presence or not of the article 2 by measuring the depression existing in the aspirating conduit 102B.

The device 200, in the second embodiment thereof, comprises the above-described organs, with reference to the first embodiment, and is different from the first embodiment only due to the presence of conveyor organs 201 which interpose between the operating head 101 and the blister strip 10, during the stage of filling the blisters 11, in order to guide the articles 2 unloaded by the gripping units 102 and if necessary to correct wrong orientations, such as to make them correspond to the underlying blisters 11.

The conveyor organs 201 are constituted, for example, by a plate in which funnel conduits 202 are realized, coaxial with the blisters 11, each having a relative upper inlet section 202A, being preferably circular and having an area which is adequately greater than that of the corresponding gripping unit 102, and the lower outlet section 202B being shaped in accordance with the blister 11 and having the same orientation thereas on the horizontal plane.

Figure 10:
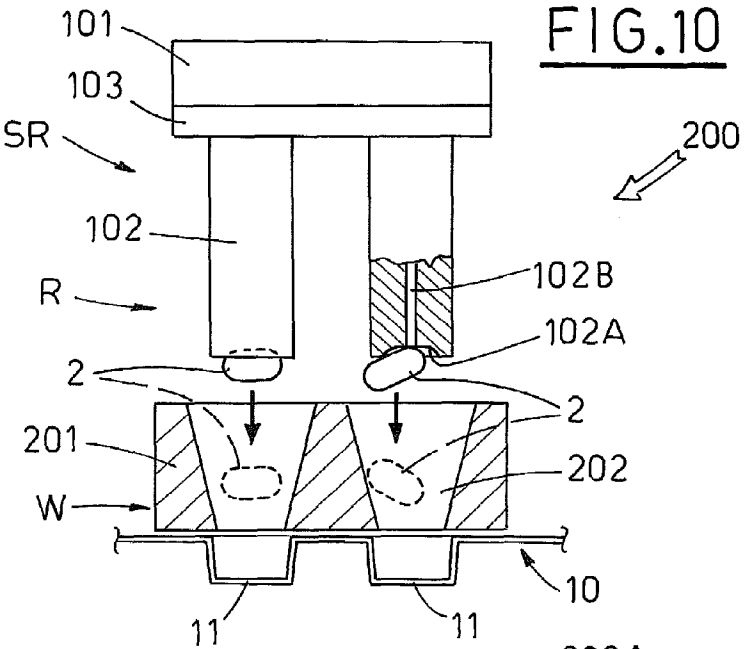
FIGS. 10 and 11 illustrate two sections according to plane X-X of FIG. 9, with the device in two successive operating stages.
Figure 11:
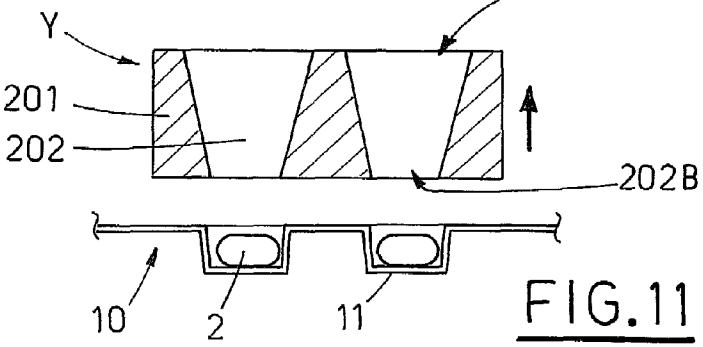
Figure 9:
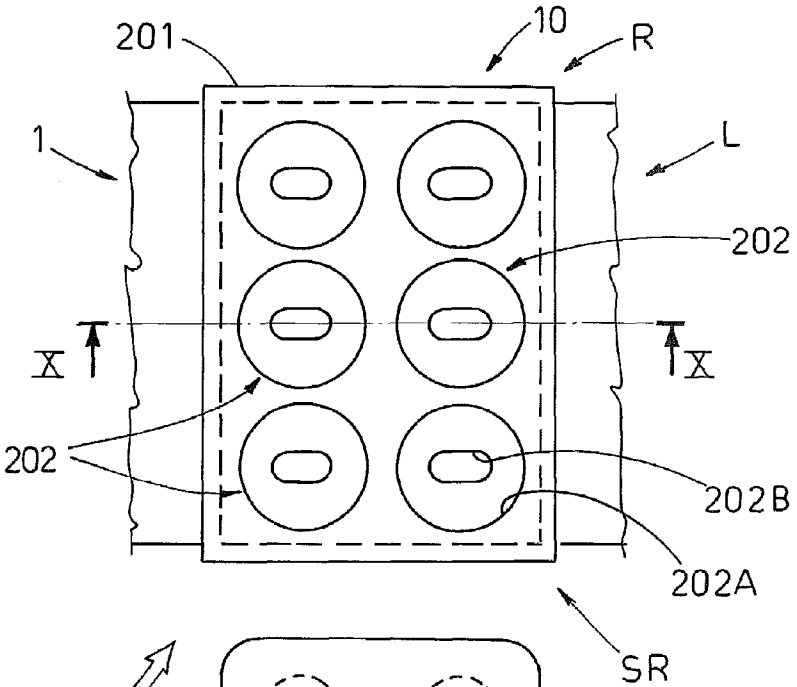
FIG. 9 is a similar view to FIGS. 6, 7, with the device in a second embodiment thereof.
Figure 9:
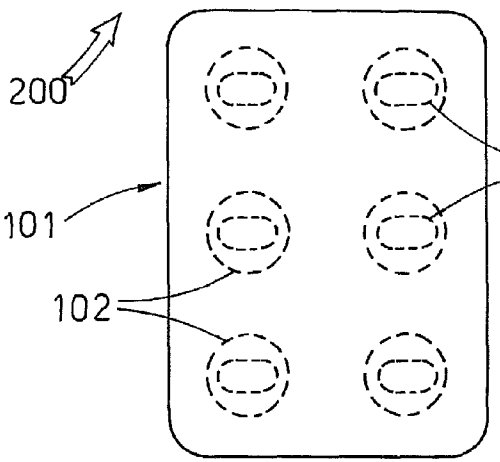

The plate 201 is arranged above the blister strip 10, in the release station R, and in a preferred embodiment is associated to activating means, not illustrated, for lowering it into a work position W, in which the lower outlet sections 202B are as close as possible to the blisters (FIG. 10), and for raising it into a rest position Y, displaced from the heat-formed strip 1 (FIG. 11).

Figure 8:
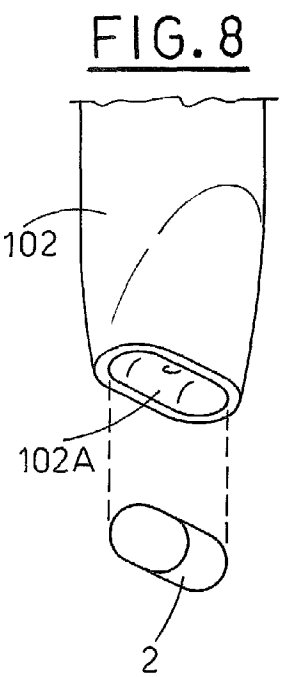
FIG. 8 is a perspective view of a gripping unit of the device of FIGS. 6 and 7.

The second embodiment prevalently concerns insertion of elongate articles, for example similar to those in FIGS. 6, 7, 8, for which a not—perfectly-centered grip is more probable on the part of one or more units 102 (see FIG. 10). The functioning of the device 200 in the second embodiment is entirely similar to the preceding embodiment as far as the stage of picking up of the articles 2 from the station P is concerned; the head 101 is then displaced into the release station R at a height such that the articles 2, even if not gripped correctly, stay above the plate 201, with the plate predisposed in the work position W (see FIG. 10 once more).

The articles 2, released by the gripping units 102, fall into the funnel conduits 202 and by force of gravity reach the underlying blisters 10, self-correcting any orientation faults to insert therein.

In phase-relation with the return run of the operating head 101, the plate 201 is raised into the rest position Y thereof (FIG. 11) in order to enable the heat-formed strip 1 to advance without risk of dragging.

Figure 13:
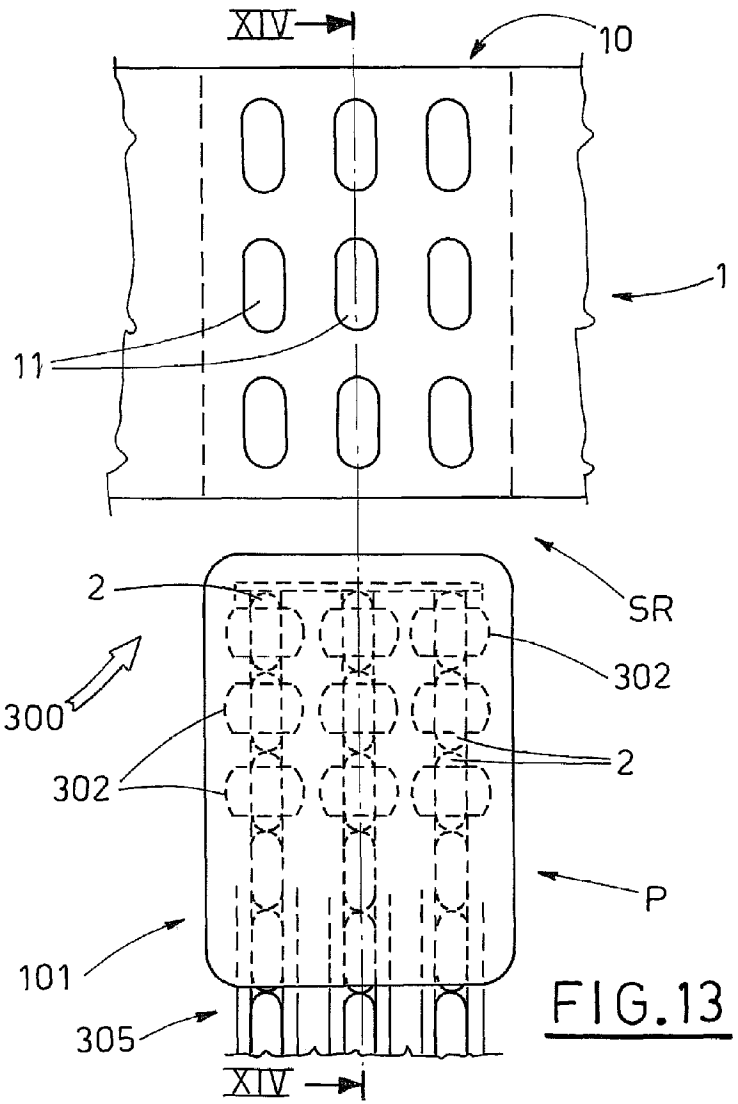
FIGS. 12 and 13 illustrate, in views similar to that of FIG. 9, a third embodiment of the device, in two operating stages of the picking up of the articles.
Figure 12:
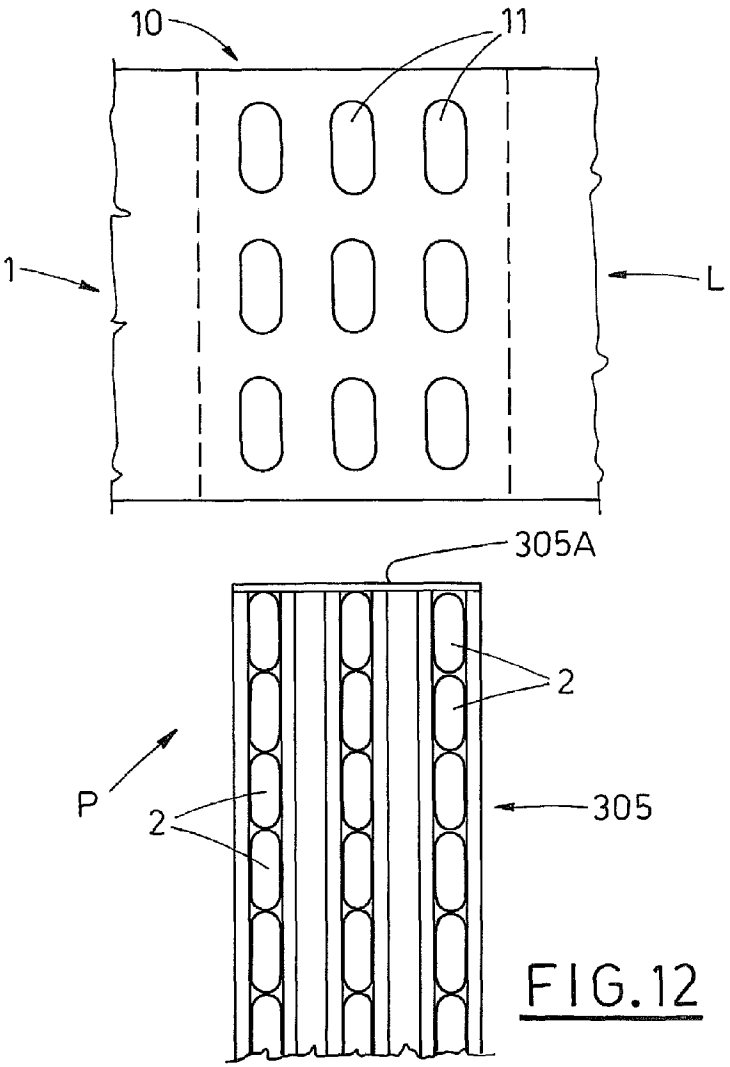

The device 300, in the third embodiment thereof, comprises the above-described organs with reference to the first embodiment, and differs from the said first embodiment in the following:

the picking up station P, in which instead of the tray 105 there is a dispenser 305 in which the articles 2 are ordered, one close after another, in parallel rows having a same interaxis as the rows of blisters 11 of each blister 10, considered in a transversal direction to the advancement direction of the heat-formed strip 1, with the rows of articles 2 being maintained against a front abutment 305A of the dispenser 305 (FIGS. 12, 14);

the conformation of the gripping units 302, which must exhibit, in the development direction of the rows of articles 2, a smaller relative size than the articles 2, going in that same direction (FIGS. 13, 14);

the conformation of the connecting organs 303, no longer of fixed type, but provided with motorized means, not illustrated in detail, for example sliding means for varying the interaxis of the relative gripping units 302 according to the development directions of the respective rows of articles 2, between a minimum value corresponding to that of the articles 2 which are in contacting lines (FIG. 13 and the broken lines in FIG. 14) and a maximum value, corresponding to that of the blisters 11 in the transversal direction to the heat-formed strip 1 (FIG. 16 and the continuous lines in FIG. 14).

The functioning of the device 300 in the third embodiment thereof is such that when the operating head 101, at the end of its return run, reaches the picking up station P, the connecting organs 303 have arranged the gripping units 302 in the minimum interaxis position in order to enable them, following the lowering of the head 101, to pick up a corresponding number of articles 2 from the head of each row of the dispenser 305 (FIG. 13 and the broken lines in FIG. 14).

In phase relation with the raising of the head 101, the connecting organs 303 newly distance the gripping units 302 at a distance equal to the interaxis of the blisters 11 (FIG. 14).

Thereafter, in a similar procedure to what has already been described, the operating head 101 performs its outward run towards the release station R in order to deposit the articles 2 in the corresponding blisters 11.

Figures from 12 to 16 illustrate a condition in which the blisters 11 are oriented perpendicular to the heat-formed strip 1; for different orientations of the blisters 11 the conveyor organs 201 described in reference to the second embodiment herein can be used to advantage.

The device 400, in the fourth embodiment thereof, is destined to fill the blister strip 10 with first and second articles 2A, 2B having different characteristics, for example in terms of shape and/or colour.

Each blister strip 10 consequently affords first blisters 11A for receiving the first articles 2A and second blisters 2B for receiving the second articles.

Figures 17, 18, 19:
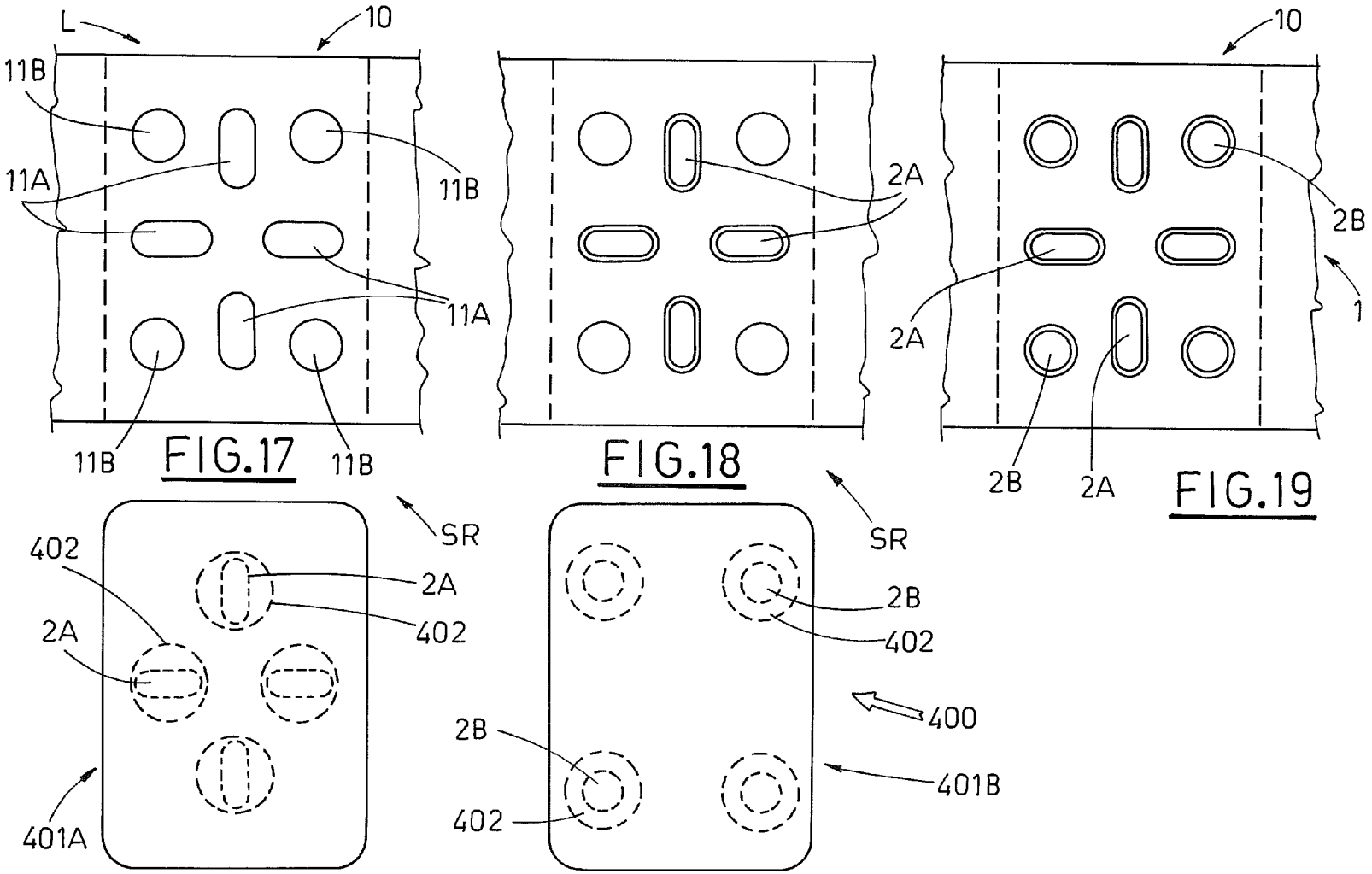
FIGS. 17, 18, 19 illustrate, in similar views to that of FIG. 9, a fourth embodiment of the device, with two operating heads, in successive stages for filling a blister strip having blisters of two different shapes for two different articles.

The filling of the first and second blisters 11A, 11B is done by means of two operating heads 401A, 401B arranged in series, respectively first and second, each of which is associated to organs which can be, alternatively, similar to what is described with reference to the first, second and third embodiments; for the sake of simplicity, in FIGS. 17, 18 and 19 reference is made to a similar condition with the first embodiment.

As is clearly deducible from the above-cited figures, then, the first operating head 401A, with relative gripping units 402, duly distanced and oriented, inserts the first articles 2A in the corresponding first blisters 11A, while the second head 401B, positioned downstream, inserts the second articles 2B in the remaining second blisters 11B.

Obviously a greater number of heads than two can be used if the formats of articles to be inserted in a same blister strip are more than two.

In further variants, not illustrated, relating to each of the embodiments described up to now, the device 100, 200, 300, 400 is provided with multiple organs for contemporaneously filling more than a blister strip in each operating cycle.

From the above, the advantageous characteristics of the proposed device are obvious, in particular in relation to the functionality and the versatility of use, which are constant independently of the shape of the articles and/or the arrangement of the blisters in the relative blister strip.

Thanks to the operative flexibility of the device, each blister packer machine can be easily adapted to various formats, both in relation to the product and to the blister pack, while maintaining a standard of reliability and increasing the range of uses of the machine itself.

A further advantage, deriving from the conformation of the device, relates to the small number of the components dedicated to the format, i.e. the gripping units and the positioning organs, which can constitute a single assembly and can be replaced with a single and rapid operation.

The solution at the base of the device of the invention, both in the indicated illustrated embodiment as well as in others which have not been illustrated herein, means obtaining excellent performance for various blister-packing models, including those operating at high speed.

The advantageous characteristics of the proposed device enable filling of blister strips which, in an extreme case, might have each blister differently formed in order to receive totally different articles, and these could be oriented in any way; which would be impossible with the known solutions, if not at the price of huge complications, with increases of machine size and costs.

This broad possibility of variation means that various articles can be packed together in a same blister strip, for example for special treatment cycles, with obvious advantages, commercial advantages for the producer and practical advantages for the end user.

The above-described device is substantially constituted by a small number of elements of simple conception and limited cost, which elements are moved by organs such as robotic arms which are very well tried and tested and which, though not being inexpensive, have known costs unlikely to undergo very large unexpected rises in price due to the results of experimentation; their price also reflects accurately the level of their performance.

The above is however intended as a non-limiting example of the device; modifications of details thereof, to any one of its illustrated embodiments, and to other embodiments too, for construction and/or functional reasons, will be considered forthwith to enter within the ambit of protection therefore, as defined in the following claims.

What is claimed is:

1. A device for picking up articles from a supply station and depositing the articles in corresponding blisters of a blister strip, wherein the device comprises:

at least a group of depression-activated gripping units, each of which units is shaped to a specific format for receiving and retaining a corresponding article having predetermined lie and orientation;

connecting organs for connecting the gripping units to an operating head in which the gripping units are positioned in relation to a positioning of the corresponding blisters afforded in the blister strip;

organs for moving the operating head in outward and return runs, respectively between the supply station of the articles and a release station of the articles in the corresponding blisters of the blister strip;

enabling organs being activated in phase-relation with the moving organs, for activating the gripping units in the supply station, which gripping units collect a number of articles equal to a number of the gripping units, and for deactivating the gripping units in the release station with a disengagement of the articles from the gripping units and a falling of the articles into the corresponding blisters of the blister strip;

conveyor organs for interposing between a relative operating head and the blister strip, prior to filling of the blisters, for guiding the articles released by the gripping units to assume a predetermined orientation on a horizontal plane, which orientation matches an orientation of relative underlying blisters of the blister strip; and wherein the conveyor organs are associated to activating means, which define, for the conveyor organs, a lowered work position, in which the lower outlet sections are immediately above the blisters, and a raised rest position, in which the lower outlet sections are distanced from the blisters.

2. The device of claim 1, wherein a number of gripping units is included which number is equal to a number of the blisters in a blister pack of the blister strip, and in that the gripping units are positioned in relation to the positioning of the corresponding blisters afforded in the blister strip.

3. The device of claim 2 further comprising at least an infeeder provided in the supply station, in which infeeder the articles are ordered, one close by another, on parallel rows having a same interaxis as rows of the blisters present in the blister strip, with the rows of articles retained against a front abutment present in the feeder.

4. The device of claim 1, wherein the conveyor organs are constituted by a plate in which funnel-shaped conduits, coaxial with the blisters are afforded, each of the funnel-shaped conduits exhibiting an upper inlet section having a larger area than a corresponding gripping unit, and a lower outlet section shaped to a format which accords with the corresponding blister and with an orientation thereof with respect to a horizontal plane.

5. The device of claim 1, wherein the gripping units each comprise an elongate body, developed in a downwards direction with a vertical axis and inferiorly shaped such as to define a seating having a shape and a size which match a shape and size of the articles, and an orientation on a horizontal plane which corresponds to an orientation of a relative blister of the blister strip.

6. The device of claim 5, wherein longitudinal conduits are afforded respectively in the body of the gripping units, one of the longitudinal conduits being provided for each of the gripping units, which conduits open at the seatings and bear the enabling organs.

7. The device of claim 1, wherein the connecting organs are fixed and bear the group of gripping units, which are constrained thereto.

8. The device of claim 1, wherein the moving organs are constituted by at least a robotic arm functioning along Cartesian axes and having electronically-controlled movements.

9. The device of claim 1, characterized that the moving organs are constituted by at least a robotic arm having electronically-controlled anthropomorphic movements.

10. The device of claim 1, further comprising at least an infeeder provided in the supply station, in which infeeder the articles are ordered, one close by another, on parallel rows having a same interaxis as rows of the blisters present in the blister strip, with the rows of articles retained against a front abutment present in the feeder.

11. The device of claim 10, wherein the connecting organs are provided with motorised means, destined to vary the interaxis of the relative gripping units, according to the development directions of the respective rows of articles in the infeeder and blister strip, between a minimum value of interaxis, identified by the articles mutually in contact in the infeeder and a maximum value of interaxis, identified by the blisters in the blister strip.

12. The device of claim 11, wherein in the development direction of the rows of articles the feeder, the gripping units exhibit a smaller size than a size of the articles.

13. The device of claim 1 further comprising control means associated to the operating head, for verifying presence, in the gripping units, of a corresponding article following a picking up stage thereof.

14. The device of claim 13, wherein the control means are of a depression-measuring type.

15. A device for picking up articles from a supply station and depositing the articles in corresponding blisters of a blister strip, wherein the device comprises:

at least a group of depression-activated gripping units, each of which units is shaped to a specific format for receiving and retaining a corresponding article having predetermined lie and orientation;

connecting organs for connecting the gripping units to an operating head in which the gripping units are positioned in relation to a positioning of the corresponding blisters afforded in the blister strip;

organs for moving the operating head in outward and return runs, respectively between the supply station of the articles and a release station of the articles in the corresponding blisters of the blister strip;

enabling organs being activated in phase-relation with the moving organs, for activating the gripping units in the supply station, which gripping units collect a number of articles equal to a number of the gripping units, and for deactivating the gripping units in the release station with a disengagement of the articles from the gripping units and a falling of the articles into the corresponding blisters of the blister strip; and wherein operating heads are provided, arranged in series and provided with relative groups of gripping units and destined to successively insert articles which are different to one another into corresponding blisters of the blister strip.

16. The device of claim 15, wherein the blisters define a blister pack.

17. The device of claim 15 further comprising at least an infeeder provided in the supply station, in which infeeder the articles are ordered, one close by another, on parallel rows having a same interaxis as rows of the blisters present in the blister strip, with the rows of articles retained against a front abutment present in the feeder.

18. A device for picking up articles from a supply station and depositing the articles in corresponding blisters of a blister strip, wherein the device comprises:

at least a group of depression-activated gripping units, each of which units is shaped to a specific format for receiving and retaining a corresponding article having predetermined lie and orientation;

connecting organs for connecting the gripping units to an operating head in which the gripping units are positioned in relation to a positioning of the corresponding blisters afforded in the blister strip;

organs for moving the operating head in outward and return runs, respectively between the supply station of the articles and a release station of the articles in the corresponding blisters of the blister strip;

enabling organs being activated in phase-relation with the moving organs, for activating the gripping units in the supply station, which gripping units collect a number of articles equal to a number of the gripping units, and for deactivating the gripping units in the release station with a disengagement of the articles from the gripping units and a falling of the articles into the corresponding blisters of the blister strip;

wherein at least one tray is located in the supply station, into which said at least one tray the articles are fed loosely, forming a heap of the articles in which the depression-activated gripping units, borne by said relative operating head activated by the moving organs, are partially introduced; and wherein the moving organs impress a horizontal motion of a predetermined entity and direction on the operating head, in a phase relation with the insertion of the gripping units into the heap of articles in order to facilitate spontaneous engaging of the articles by the gripping units.

19. The device of claim 18, wherein organs are present in the tray, which organs maintain a predetermined level of the articles, which level is homogeneous throughout the tray.

20. The device of claim 18, wherein the moving organs are constituted by at least a robotic arm functioning along Cartesian axes and having electronically-controlled movements.

21. The device of claim 18, characterized that the moving organs are constituted by at least a robotic arm having electronically-controlled anthropomorphic movements.

* * * * *